United States Patent [19]

Turner

[11] 4,190,063

[45] Feb. 26, 1980

[54] SMOKER'S PIPE

[76] Inventor: Denver R. Turner, 405 Oakdale Ave., S. Charleston, W. Va. 25303

[21] Appl. No.: 796,136

[22] Filed: May 12, 1977

[51] Int. Cl.[2] ..... A24F 1/02; A24F 5/04

[52] U.S. Cl. ..... 131/195; 131/196; 131/198 A

[58] Field of Search ..... 131/198 R, 216, 198 A, 131/227, 225, 226, 171 R, 174, 171 A, 195, 196, 170, 223, 200, 176, 178, 223

[56] References Cited

U.S. PATENT DOCUMENTS 1,967,367 7/1934 Miele ..... 131/198 A 3,791,390 2/1974 Hendricks ..... 131/196

*Primary Examiner*—Vincent Millin

*Attorney, Agent, or Firm*—Daniel Jay Tick

[57] ABSTRACT

A smoker's pipe has a tobacco bowl for burning tobacco and a stem extending from the bowl. A control system produces a draft via a free flow of air through tobacco in the bowl whereby the tobacco burns freely and evaporates moisture in the tobacco and eliminates nicotine and tar to provide a milder smoke when the pipe is free from drawing and puffing by a smoker. The control system draws smoke from burning tobacco in the bowl through the stem to the smoker's mouth when the smoker draws or puffs.

3 Claims, 5 Drawing Figures

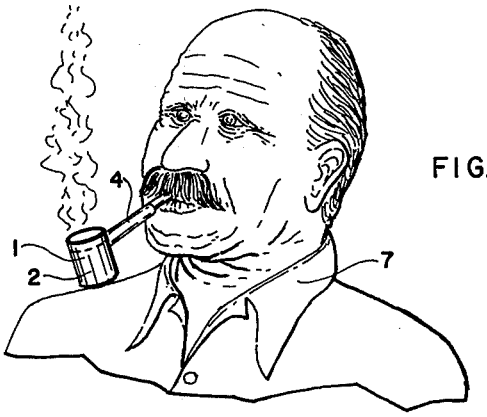
FIG. 1
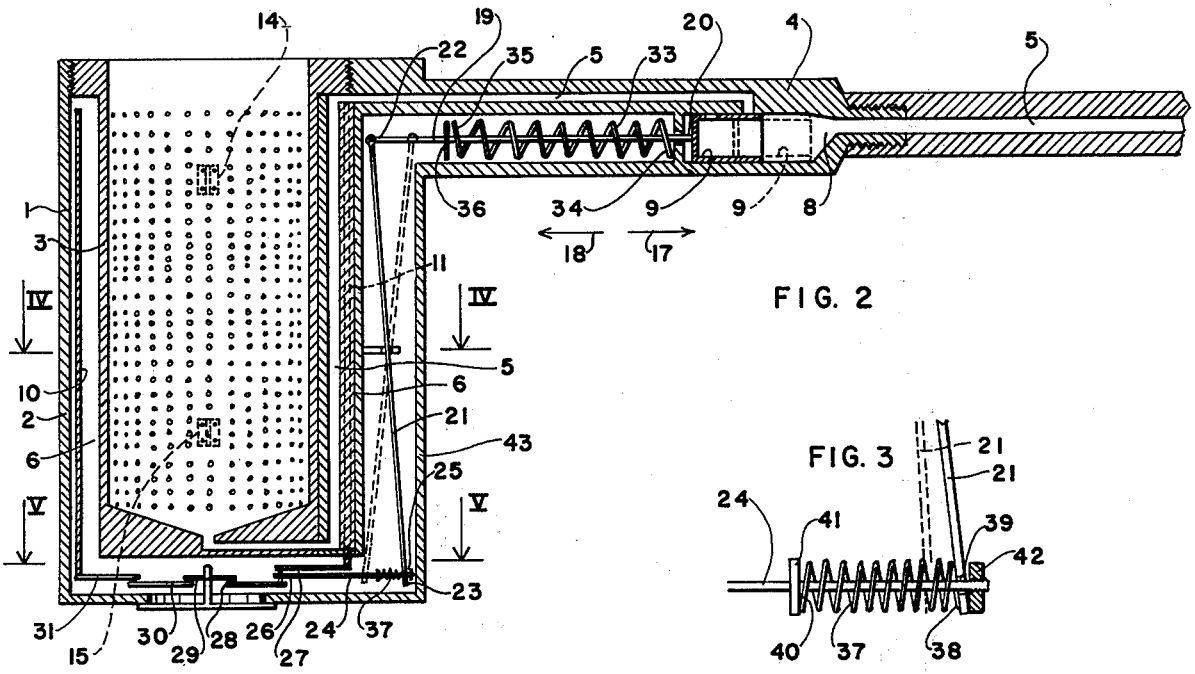
FIG. 2
FIG. 3
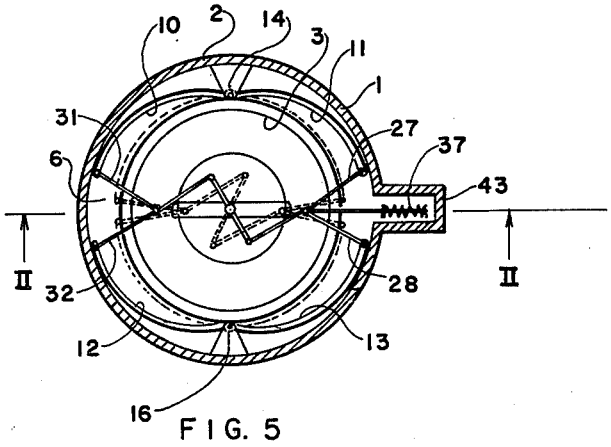
FIG. 5
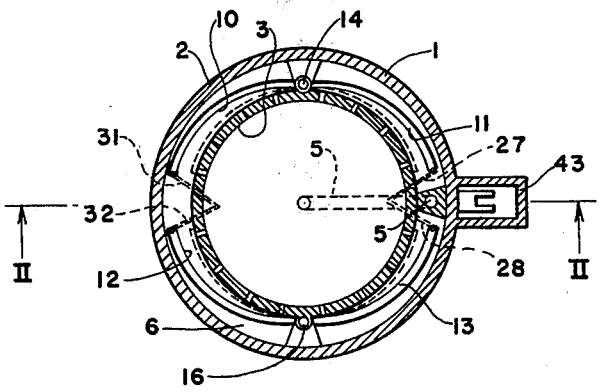
FIG. 4

SMOKER'S PIPE

BACKGROUND OF THE INVENTION

The present invention relates to a smoker's pipe.

Objects of the invention are to provide a smoker's pipe of simple structure, which is inexpensive in manufacture, used with facility, convenience and safety, and functions efficiently, effectively and reliably to provide a free flow of air through the tobacco bowl when the smoker is not puffing or drawing on the pipe causing a draft which results in the free burning of the tobacco, thereby evaporating the moisture in the tobacco and maintaining the burning of the tobacco so that much nicotine and tar are eliminated to produce a milder smoke.

BRIEF DESCRIPTION OF THE DRAWINGS

In order that the invention may be readily carried into effect, it will now be described with reference to the accompanying drawings, wherein:

FIG. 1 is a view of an embodiment of the smoker's pipe of the invention in use;

FIG. 2 is a cross-sectional view, on an enlarged scale, of an embodiment of the smoker's pipe of the invention;

FIG. 3 is a view, on an enlarged scale, of part of the control system of the embodiment of FIG. 2;

FIG. 4 is a cross-sectional view, taken along the lines IV—IV, of FIG. 2; and

FIG. 5 is a cross-sectional view, taken along the lines V—V, of FIG. 2.

DETAILED DESCRIPTION OF THE INVENTION

The smoker's pipe of the invention comprises a tobacco bowl 1 for burning tobacco. The tobacco bowl 1 comprises an outer tobacco bowl 2 and a perforated inner bowl 3 of smaller diameter than the outer bowl, coaxially positioned in said outer bowl for holding burning tobacco (FIGS. 2, 4 and 5).

A stem 4 extends from the bowl 1 (FIGS. 1 and 2). The stem 4 has an air passage 5 (FIG. 2) extending therethrough and opening into an area of space 6 between the inner and outer bowls 3 and 1, as shown in FIGS. 2 and 4. The air passage 5 extends to, and opens in, the bottom of the inner bowl 3.

A control system produces a draft via a free flow of air through tobacco in the inner bowl 3 whereby the tobacco burns freely and evaporates moisture in the tobacco and eliminates nicotine and tar to provide a milder smoke when the smoker 7 (FIG. 1) does not draw or puff on the pipe. The control system draws smoke from burning tobacco in the inner bowl 3 through the stem 4 to the smoker's mouth, when the smoker draws or puffs on the pipe.

A chamber 8 is formed in the air passage 5 in the stem 4, as shown in FIG. 2. A valve 9 of any suitable type (FIG. 2) is provided in the chamber 8 and is moved by the smoker 7 drawing and puffing on the stem 4.

The control system comprises a first set of flaps 10 and 11 (FIGS. 4 and 5) and a second set of flaps 12 and 13 (FIGS. 4 and 5). The first and second pairs of flaps 10, 11 and 12, 13 are hingedly mounted in the area of space 6 between the inner and outer bowls 3 and 1 in operative proximity with the outside surface of the inner bowl for selectively covering and uncovering the perforations of said inner bowl. Thus, the first pair of flaps 10, 11 are hingedly mounted via a pair of hinges 14 and 15 (FIG. 2) of which the hinge 14 is shown in FIGS. 4 and 5, as well as FIG. 2. The second pair of flaps 12, 13 are hingedly mounted via a second pair of hinges, in the same manner as the first pair of flaps, diametrically opposite the first pair of hinges. One of the hinges 16 mounting the second pair of flaps is shown in FIGS. 4 and 5.

The control system further comprises a linking device linking the valve 9 to the first and second pairs of flaps 10, 11 and 12, 13. The linking device comprises a plurality of rods movably coupled to each other in a manner whereby linear motion of the valve 9 in directions of arrows 17 and 18 in FIG. 2 result in pivotal or rotary motion of the flaps about their hinges in a manner whereby the flaps either cover the perforations of the inner bowl 3 or uncover said perforations. The linking device includes a first coupling rod 19 affixed at one end 20 to the valve 9 and pivotally affixed to a second rod 21 at its opposite end 22. The opposite end 23 of the second rod 21 has a bore formed therethrough and rides freely on a third rod 24 extending parallel to and spaced from the first rod 19. The end 23 of the rod 21 rides freely on the rod 24 at the end 25 of the rod 24. The opposite end 26 of the rod 24 is pivotally affixed to the flaps 11 and 13 via links 27 and 28, respectively, and is pivotally affixed to the flaps 10 and 12 via a series of links 28, 29, 30, 31 and 32 (FIGS. 2 and 5). A first control spring 33 (FIG. 2) is provided around the rod 19 and is restricted at one end 34 by a wall of the stem through which said rod passes and is restricted at its opposite end 35 by a collar 36 of said rod. A second control spring 37 (FIGS. 2, 3 and 5) is provided around the rod 24 and is restricted at one end 38 by the second rod 21 through the bore 39 of which the rod 24 passes and is restricted at its opposite end 40 by a collar 41 of said rod. The rod 21 is prevented from slipping off the rod 24 by a second collar 42 affixed to the rod 24.

When the smoker does not draw or puff on the pipe, the valve 9 is in its position shown in FIG. 2 and thereby moves the flaps 10, 11, 12 and 13 away from the inner bowl 3 via the linking device, as shown by solid lines in FIGS. 2, 4 and 5, to free the perforations of said inner bowl thereby producing a draft via a free flow of air through tobacco in said inner bowl whereby the tobacco burns freely and evaporates moisture in the tobacco and eliminates nicotine and tar to provide a milder smoke. When the smoker 7 draws or puffs, the valve 9 is moved to another position, shown by broken lines in FIG. 2, thereby moving the flaps 10, 11, 12 and 13 to cover the perforations of the inner bowl 3 via the linking device, as shown by broken lines in FIGS. 2, 3, 4 and 5, to enclose the inner bowl and draw smoke from said inner bowl via the bottom thereof and the air passage 5 of the stem.

When the smoker 7 finishes puffing or drawing on the pipe, the pressure on the valve 9 is relieved and the first control spring 33 moves said valve to its solid line position shown in FIG. 2 to open the flaps 10 to 13 via the linking device.

If dirt or ashes get into the connections of the linking device or the control springs or valve 9, the rod 21 may be moved about its center, as indicated by the solid and broken lines of FIG. 2, to reinstitute the smooth operation of the pipe of the invention. The movable parts and leverage are adjusted to operate freely and all joints are loose to avoid friction. The second control spring 33 takes up the slack between the flaps and the tobacco bowl to assure a firm fit of the flaps against the tobacco bowl when said flaps cover the perforations of said tobacco bowl and also to take up any slack in the linking components.

A protruding part 43 of the tobacco bowl 1 is removable for cleaning and assembling the parts of the pipe. This is readily accomplished by mounting the part 43 in grooves so that it may be readily removed and protects the parts from dirt and damage.

While the invention has been described by means of a specific example and in a specific embodiment, I do not wish to be limited thereto, for obvious modifications will occur to those skilled in the art without departing from the spirit and scope of the invention.

I claim:

1. A smoker's pipe, comprising a tobacco bowl for burning tobacco said tobacco bowl having an outer tobacco bowl and a perforated inner tobacco bowl of smaller diameter than the outer bowl coaxially positioned in the outer bowl for holding burning tobacco;

a stem extending from the outer bowl; and control means for permitting a draft, wherein said inner bowl has perforations that are open when the control means is not being drawn or puffed on, via a free flow of air through tobacco in the inner bowl whereby the tobacco burns freely and evaporates moisture in the tobacco and eliminates nicotine and tar to provide a milder smoke when the pipe is free from drawing and puffing by a smoker, and for drawing smoke from burning tobacco in the inner bowl through the stem to the smoker's mouth said perforations of said inner bowl are closed when the smoker draws or puffs.

2. A smoker's pipe as claimed in claim 1, wherein the stem has an air passage extending therethrough and opening into an area of space between the inner and outer bowls, a chamber formed in the air passage in the stem and valve means in the chamber and moved by drawing and puffing on the stem, said valve means being coupled to said control means and controlling the operation thereof.

3. A smoker's pipe, comprising a tobacco bowl for burning tobacco, said tobacco bowl comprising an outer tobacco bowl and a perforated inner tobacco bowl of smaller diameter than the outer bowl coaxially positioned in the outer bowl for holding burning tobacco;

a stem extending from the outer bowl, said stem having an air passage extending therethrough and opening into an area of space between the inner and outer bowls, a chamber formed in the air passage in the stem and valve means in the chamber and moved by drawing and puffing on the stem; and control means for permitting a draft via a free flow of air through tobacco in the inner bowl whereby the tobacco burns freely and evaporates moisture in the tobacco and eliminates nicotine and tar to provide a milder smoke when the pipe is free from drawing and puffing by a smoker, and for drawing smoke from burning tobacco in the inner bowl through the stem to the smoker's mouth when the smoker draws or puffs, said control means comprising flap means hingedly mounted in the area of space between the inner and outer bowls in operative proximity with the outside surface of the inner bowl for selectively covering and uncovering the perforations thereof and linking means linking the valve means to the flap means whereby when the pipe is free from drawing and puffing by a smoker the valve means is in one position thereby moving the flap means away from the inner bowl via the linking means to free the perforations thereof and when the smoker draws or puffs the valve means is moved to another position thereby moving the flap means to cover the perforations of the inner bowl via the linking means to enclose the inner bowl and draw smoke from said inner bowl via the bottom thereof and the air passage of the stem.

* * * * *